United States Patent [19]

Clark et al.

[11] Patent Number: 4,870,789

[45] Date of Patent: Oct. 3, 1989

[54] MANUFACTURED BUILDING ADJUSTABLE LEVELING AND SUPPORT DEVICE

[76] Inventors: Steven J. Clark, 19222 Old Ward's Ferry Rd., Sonora, Calif. 95370; William C. Fields, 17786 Black Bart Dr., Jamestown, Calif. 95327

[21] Appl. No.: 140,608

[22] Filed: Jan. 4, 1988

[51] Int. Cl.[4] ..... F16M 13/00

[52] U.S. Cl. ..... 52/126.6; 52/126.3; 52/126.5; 248/354.3; 248/357

[58] Field of Search ..... 248/352, 354.3, 357; 52/126.6, 126.5, 126.1, 126.3

[56] References Cited

U.S. PATENT DOCUMENTS

| | | | |
|---|---|---|---|
| 2,439,854 | 4/1948 | Lipski | 248/352 |
| 3,222,030 | 12/1965 | Thorpe | 52/126.6 |
| 3,232,584 | 2/1966 | Miles | 248/352 |
| 3,470,663 | 10/1969 | Tate | 248/357 |
| 3,831,329 | 8/1974 | Lear | 248/354.3 |
| 3,920,212 | 11/1975 | Westwood | 248/352 |
| 3,921,356 | 11/1975 | Hughes | 248/357 |
| 4,014,517 | 3/1977 | Keagle | 248/352 |
| 4,141,526 | 2/1979 | John | 248/352 |
| 4,404,780 | 9/1983 | Josephson | 248/357 |
| 4,631,878 | 12/1986 | Laramore | 52/126.6 |
| 4,684,097 | 8/1987 | Cox | 248/354.3 |
| 4,718,628 | 1/1988 | Vitta | 52/126.1 |

FOREIGN PATENT DOCUMENTS

| | | | |
|---|---|---|---|
| 94053 | 6/1959 | Norway | 248/354.3 |
| 389878 | 7/1965 | Switzerland | 248/354.3 |
| 745742 | 7/1980 | U.S.S.R. | 248/352 |

*Primary Examiner*—Michael Safavi

*Attorney, Agent, or Firm*—Baker, Maxham, Jester & Meador

[57] ABSTRACT

A Manufactured Building Adjustable Leveling and Support Device is a fabricated metallic structure attached by means to a non-metallic base or footing characterized by wood, composite plastic materials, concrete or mortar, which devise, when used individually or in conjunction with other identical devices or unrelated devices or structures, provides an adjustable means of leveling and supporting the mainframe chassis of any manufactured building whose mainframe consists of one or more mainframe beams characterized by metallic "I" beams, "C" channel or other such structural shapes running the length or width of the building. Said device consists of a fabricated base structure consisting of a center tube supported on its outside by a number of legs sufficient to support said center tube against anticipated vertical, horizontal and lateral stress loads, a vertical support member of varying lengths which is inserted inside the center support tube and has at its top a means of attachment of a support head or support clamp, a means of "shimming" or adjusting the length of said vertical support member, and an adjustable support head or clamp which attaches by means to the vertical support member and which head or clamp comes directly in contact with and/or attaches to the mainframe of the manufactured building being leveled with and/or supported by the Manufactured Building Adjustable Leveling and Support Device. When installed, the device can act as (a) a temporary leveling device, (b) a permanent support device used in conjunction with other unrelated support devices or structures, or (3) when used in conjunction with other identical devices, can form the entire temporary or permanent foundation for the manufactured building.

9 Claims, 1 Drawing Sheet

MANUFACTURED BUILDING ADJUSTABLE LEVELING AND SUPPORT DEVICE

BACKGROUND OF THE INVENTION

Our Manufactured Building Adjustable Leveling and Support Device was invented in response for the critical need for a more substantial "pier" type foundation support for manufactured buildings such as factory built mobilehomes, portable classrooms, temporary office buildings, modular homes, construction site shacks, or any other type of manufactured building or structure which incorporates in its design one or more mainframe chassis members which run the length or width of the building, atop which mainframe chassis members the building or structure is fabricated.

At the present time the general method of supporting and leveling such a building or structure is to install a large number of flimsy and highly unstable steel piers which consist typically of an 8" to 12" wide square base at each corner of which is attached lengths of ¾" to 1" pieces of angle iron which at their other ends are joined together in a pyramid shape by a collar which has a center hole that facilitates the attachment of a support head consisting of a metal plate to the bottom of which is attached a threaded rod which inserts through the center hole of the collar at the top of the pier and a nut used to adjust the height of the support head. The support head is supposed to provide support to the mainframe of the building.

The bases and legs of these piers typically are fabricated from very thin metal (0.075–0.120 avg. gage). The support heads typically consist of a 1½"×3" 18 gage plate attached to a 5"×¾" piece of threaded rod stock and an adjustment nut. The average rated capacity is about 2,500 lbs of vertical load. They are not rated for horizontal or lateral loads and have very little capacity for such loading. These piers have no center line member which carries their load directly to the ground in a straight line with the vertical load they support. All vertical bearing capacity is borne along the four legs to the corners of the square base at a tangent angle to the load, a very inefficient and undesirable load bearing configuration compared to the direct, straight line load transfer to ground of our device. Resistance of these currently used piers to tilting and tipping is minimal at best. The typical standard pier has a leg angle to base ranging from 60 to as much as 75 degrees. The typical height from base to tip of the pyramid exceeds the width of the base by at least 2 to 1 giving the device a small base and tall height which tends to make the device subject to being easily tipped over when it is subjected to any sort of sideward motion or stress. Once this tipping motion is started, the load is immediately transferred to only one or two of the four legs which immediately causes at least a doubling or more of the load moment on those legs depending on the amount of sideward load acceleration. This circumstance many times results in the collapse of the pier or piers and allows the building to fall to the ground.

The support head of the standard pier is not mechanically attached to the mainframe in any way. It resists sideward movement or stress only by dead load friction. When the building supported by standard piers is subjected to sideward motion or stress which exceeds the dead load friction resistance to movement, the building only has to move an average of 2" to leave the pier. There are a considerable number of documented cases where manufactured buildings have simply, over a period of time, vibrated off the pier support heads and fell to the ground because of this lack of mechanical attachment.

These negative characteristics of standard piers have been particularly evident in areas where such building are subjected to earthquake related ground movement. Experience in California over the past twenty years has shown that standard piers under manufactured buildings have a very high rate of failure due to the design flaws detailed above. There has been and currently is a critical need for the invention of a product that combines the ease of and convenience of pier type installations with a safer and more reliable design that reduces or eliminates the shortcomings of the currently used pier supports as well as providing the resistance needed to vertical, horizontal and lateral loads and load accelerations which such buildings may be subjected to during earthquakes and other forms of extraordinary stress loading conditions. Our invention does just that.

The current practice to provide a safe and stable foundation for a manufactured building is to install a standard pier type mainframe foundation then augment that system with a separate earthquake bracing system designed to resist horizontal or lateral movement. The cost of such a combined system averages from $4,000.00 to $7,500.00.

Using our system as an earthquake bracing and support system that augments a standard pier foundation would save the consumer an average of $900.00 to $3,000.00 over conventional earthquake bracing systems. Our device combines the functions of both the standard pier support and earthquake resistive bracing at a considerably lower cost to the consumer.

All patent rights on standard pier foundation devices as described herein have long since expired.

Earthquake braces are available in various configurations and designs. Patents have been previously granted on the following earthquake braces: Quakebrace TM, patent #4,417,426, Gusguard TM, patent #4,262,149, and Safe-T-Brace, patent #4,373,307. None of the above cited examples of prior art are in the same class of product as our invention, but are products which only partially perform the functions of our invention.

Our invention consists of a fabricated base consisting of an "X" design base plate having a much broader "footprint" than conventional piers, attached by means to a base non-metallic, moisture resistant base pad or footing. At the top center of said "X" design base plate is attached a metalic vertical support housing. Lateral legs are attached to the outside ends of the "X" base plate and run at approximately 45 degree angles to the upper portion of the outside walls of the vertical support housing and there attach by means, thus forming an extremely strong pyramid shape which has the ability to transfer vertical load directly to the ground at its center in a direct line with the load it supports rather than transferring that load at a tangent angle down the legs only, as is the case with standard type pier supports. The actual vertical load bearing member of our device is a fabricated metal tube of varying lengths, the bottom end of which is inserted inside the vertical support housing and the top end of which terminates at a point above the top of the vertical support housing and has means at its top for the attachment of the mainframe support head. The mainframe support head consists of a formed metalic channel to the bottom of which is attached a threaded rod with adjustment nut which threaded rod attaches by means to the top of the vertical load bearing member. The upright flanges of the mainframe support head are provided means for the mainframe support head to mechanically attach and/or clamp, by means of our clamping devices, to the mainframe chassis member of the manufactured building our device supports. In addition to acting as a support structure for the building, our invention can also be used to level the building due to the variable lengths of the vertical load bearing member and the height adjustability of the mainframe support head by means of the threaded rod and nut.

This invention solves the problem of many shortcomings of the standard pier and doubles as a highly effective bracing and stabilization device for resistance to ground motion, vibration and other types of vertical, horizontal and lateral stresses and loads that can cause standard piers to fail and allow the manufactured building to fall. Its fully adjustable height design gives it the added versatility to act as a fine leveling device as well. Our invention considerably reduces the cost of manufacture of earthquake bracing and consequently the end cost to the consumer of a stable, reliable and extremely strong foundation for their manufactured building when compared to prior art and current installation practices.

SUMMARY OF THE INVENTION

The present invention is a device which, when used in concert with one or more other identical devices configured into a system, forms a complete foundation for a manufactured building without the need for any other or additional means of mainframe support.

Another object of the invention is to provide a secondary support means to augment, add to or strengthen an inadequate foundation formed by other devices or structures.

Another object of the invention is to provide an easy and safe means of leveling, releveling and/or adjustment of the height of the building without need of additional construction procedures or additional special leveling tools or devices.

Another object of the invention is to attach the foundation device to the building and/or provide for sure capture of the mainframe chassis member by the device in such a way as to assure the device will not be separated from the building and will remain functional during seismic events without allowing the building to fall.

Another object of the invention is to reduce manufacturing materials and labor costs as well as installation materials and labor costs required to construct an effective earthquake resistant foundation for a manufactured building.

BRIEF DESCRIPTION OF THE DRAWINGS

Other objects and advantages of the invention will become more apparent from the specification taken in conjunction with the accompanying drawings, in which.

DETAILED DESCRIPTION OF THE INVENTION

Figure 1:
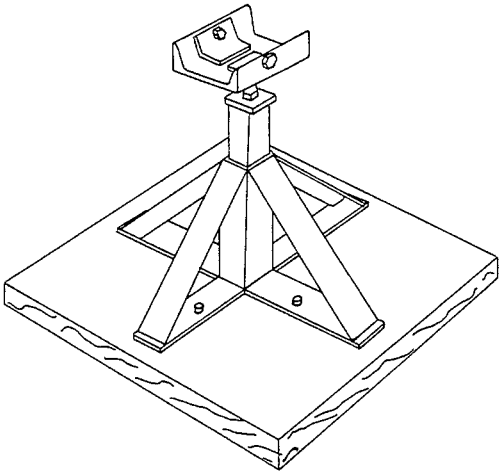
FIG. 1 is a perspective view of the completed device in fully assembled form without depiction of a base pad.

Referring to the drawing shown in FIG. 1, this drawing depicts a Manufactured Building Adjustable leveling and support device in its fully assembled state without base pad. The device can be more fully explained and the inter-relationships of the parts and components detailed in FIG. 2.

Figure 2:
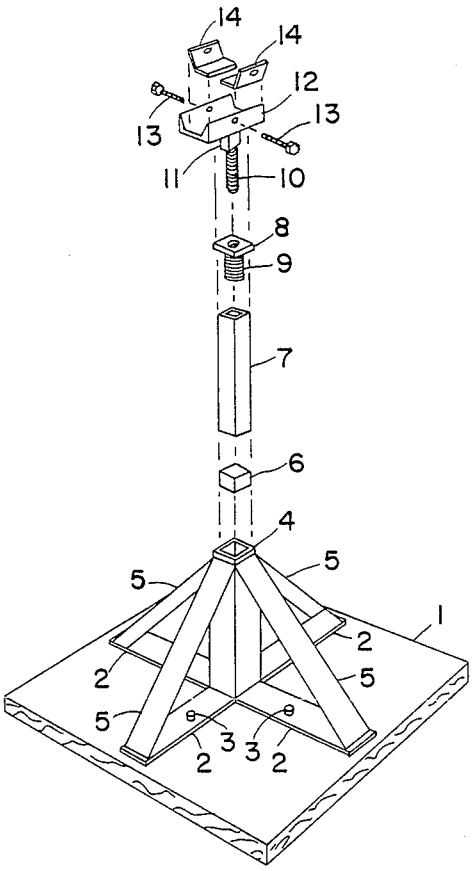
FIG. 2 is an exploded perspective view showing all parts and components in their relative positions in an unassembled state and showing the numerical designation identifying each part and component for the purposes of this patent application.

In FIG. 2 the bottom of the bottom pad 1, characterized by wood, composite materials, concrete or mortar, is in contact with the earth or other prepared surface.

The base plates 2, characterized by ferrous or non-ferrous metallic plates having therein apertures to facilitate attachment of the base plates 2, to the base pad 1, by means of the base pad attachment devices 3, are configured atop the base pad 1, in an "X" pattern and are structurally attached together by means to each other so as to form a structural metallic base for the remaining metallic parts of the device.

The bottom end of the vertical support housing 4, characterized by a ferrous or non-ferrous metalic tube, channel, pipe or other structural shape or shapes, of varying lengths, is attached by means to the center point or junction point of the base plates 2, in such a manner as to allow the vertical support housing 4, to stand at a 90 degree angle to the top surface of the base plates 2.

The lateral support legs 5, characterized by ferrous or non-ferrous angle iron, "C" channel, tube, pipe or other structural shape, attach by means at their bottom end to the outside end portion of each base plate 2, and extend upward at an approximate 45 degree angle to terminate at the upper portion of the vertical support housing 4, where they are attached by means.

Figure 3:
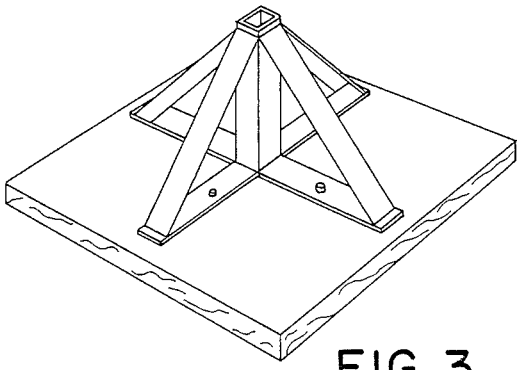
FIG. 3 is a perspective view of the base assembly in fully assembled form with wood or composite type base pad.

The base pad 1, base plates 2, base plate attachment devices 3, and vertical support housing 4 and lateral support legs 5, when fully fabricated and assembled, form the base assembly depicted in FIG. 3. which is a major component of the device.

Referring again to FIG. 2, the spacing shim 6, characterized by a ferrous or non-ferrous metalic plug or spacer of sufficient size, shape and strength to support the vertical bearing member 7, is optionally used to raise the height of the vertical bearing member 7, if needed, by dropping the spacing shim into the vertical support housing in such a manner as to allow the vertical bearing member 7, to rest atop the spacing shim 6.

The vertical bearing member 7, characterized by a ferrous or non-ferrous metalic tube, channel, pipe or other structural shape of varying lengths, matches the shape of the vertical support housing 4, and is designed to snugly insert inside the vertical support housing 4. Attached by means to the top of the vertical bearing member is the top plate 8, which is characterized by a flat ferrous or non-ferrous plate having at its center an aperture to facilitate insertion of the leveling screw 10. The leveling screw stabilizing collar 9, characterized by a ferrous or non-ferrous pipe, tube or other structural shape, is attached by means to the bottom of the top plate 8, in such a manner that the center opening of the leveling screw stabilizing collar 9, exactly aligns with the aperture of the top plate 8. The vertical bearing member 7, top plate 8, and leveling screw stabilizing collar 9, when fully fabricated into a single component, comprise the vertical bearing assembly FIG. 4, which is a major component of the device.

The leveling screw 10, characterized by a ferrous or non-ferrous threaded metal rod, attaches by means to the bottom center point of the mainframe support member 12. The leveling nut 11, characterized by a ferrous or non-ferrous metallic threaded nut, threads onto the leveling screw 10.

The Mainframe support member 12, characterized by a ferrous or non-ferrous metalic channel or other structural or fabricated shape, is designed to directly come in contact with and support the mainframe of the manufactured building. The upright flanges of the mainframe support member 12, have apertures therein to facilitate the installation by means of the mainframe capture devices 13, which are characterized by ferrous or non-ferrous metal bolts or other fastening devices which, when installed in the apertures of the upright flanges of the mainframe support member 12, would tend to "capture" the mainframe of the building and prevent it from jumping, lifting or separating from the mainframe support member 12.

The optional mainframe clamp 14, characterized by a ferrous or non-ferrous formed metalic plate having an aperture therein to facilitate attachment by means of the mainframe capture devices 13, is an eccentric "L" shaped clamp which is installed by placing its upright angled surface against the inside of the flange of the mainframe support member 12, and it horizontal surface against the upper surface of the flange of the building mainframe. When the mainframe capture devices 13 are installed through both the flange of the mainframe support member 12, and the aperture of the mainframe clamp 14, and tightened, the horizontal surface of the mainframe clamp 14 is forced downward against the flange of the building mainframe thus forming a mechanical hard attachment of the mainframe support member 12, to the building mainframe.

Figure 5:
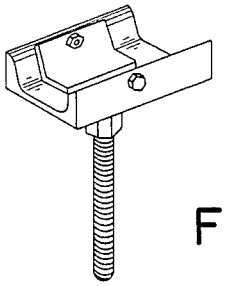
FIG. 5 is a perspective view of the mainframe support head, with mainframe clamps, in fully assembled form.

The leveling screw 10, leveling nut 11, mainframe support member 12, mainframe capture device(s) 13, and mainframe clamp(s) 14, when fully fabricated and assembled, constitute the mainframe support head assembly FIG. 5, which is a major component of the device. When installed, the mainframe support head assembly FIG. 5, permits the building the device is installed under to be easily leveled, releveled or have other building height adjustments made as may be necessary during the life of the building.

FIG. 3 depicts the base assembly with wood or composite base pad.

Figure 4:
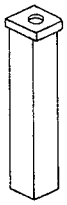
FIG. 4 is a perspective view of the vertical support assembly in fully assembled form.

FIG. 4 depicts the vertical bearing assembly.

FIG. 5 depicts the mainframe support head assembly.

The entire device, when its 3 major components are fully assembled, consists of the base assembly FIG. 3, into the top of which is inserted the vertical bearing assembly FIG. 4, (with optional spacing shims 6,) into the top of which is inserted the mainframe support head assembly FIG. 5, comprising the entire device depicted in FIG. 1.

As is thus seen from the preceding description, the Manufactured Building Adjustable Leveling and Support Device represents a quantum leap ahead in strength, stability, durability and safety compared to the standard piers generally in use today. In addition, this device provides substantially more resistance to ground motion stress, tipping, collapse and separation from mainframe members than conventional piers. The fact is that our device combines the best of both a pier type foundation and a separate earthquake bracing system into one product which costs the consumer substantially less.

The disclosure of the invention described hereinabove represents the preferrred embodiments of the invention; however, variations thereof, in form, construction, and arrangement of the various parts and components, and the modified application of the invention are possible without departing from the spirit and scope of the appended claims.

We claim:

1. An adjustable support device for a building and the like comprising:
   - a base plate for resting on a generally horizontal support surface;
   - a tubular housing having an upper end and a lower end secured at said lower end to and extending normal to said base plate for normally extending vertically therefrom;
   - a base frame assembly defined by cross frame members on said base plate for securing said tubular housing to said base plate;
   - a tubular bearing member having a length greater than said housing telescopically mounted in said housing and having means defining an upper bearing surface;
   - a mainframe support bracket having an upwardly opening channel configuration for receiving a mainframe member of a building; and
   - a screw and nut assembly secured to said support bracket for adjustably supporting same in said tubular bearing member, wherein said base frame assembly comprises a plurality of elongated rectangular plates defining said cross frame members secured to and extending outwardly from said tubular housing and a lateral support leg having a lower end secured to the outer end of each of said plates and an upper end secured to said housing at a position upward from the lower end thereof.

2. An adjustable support device for a building and the like according to claim 1 comprising at least one spacer block for supporting said tubular bearing member in said tubular housing member at a selected elevated position relative thereto.

3. An adjustable support device for a building and the like according to claim 1 wherein:
   - clamp means on said support bracket for securing a flanged mainframe member to said support bracket.

4. An adjustable support device for a building and the like according to claim 1 wherein:
   - said housing is a square tube and said base frame assembly defines a triangular frame secured between each side of said housing and said base.

5. An adjustable support device for a building and the like comprising:
   - a base plate for resting on a generally horizontal support surface;
   - a tubular housing having an upper end and a lower end secured at said lower end to and extending normal to said base plate for normally extending vertically therefrom;
   - a base frame assembly defined by cross frame members on said base plate for securing said tubular housing to said base plate, said base frame assembly comprises a plurality of elongated rectangular plates defining said cross frame members secured to and extending outwardly from said tubular housing and a lateral support leg having a lower end secured to the outer end of each of said plates and an upper end secured to said housing at a position upward from the lower end thereof;

a tubular bearing member having a length greater than said housing telescopically mounted in said housing and having means defining an upper bearing surface;

a mainframe support bracket having an upwardly opening channel configuration for receiving a mainframe member of a building;

a screw and nut assembly secured to said support bracket for adjustably supporting same in said tubular bearing member;

further comprising at least one space block for supporting said tubular bearing member in said tubular housing member at a selected elevated position relative thereto; and a screw and nut assembly mounted in said tubular bearing member and secured to said support bracket for adjustably supporting same in said tubular bearing member.

6. An adjustable support device for a building and the like comprising:

a base plate for resting on a generally horizontal support surface;

a tubular housing having an upper end and a lower end secured at said lower end to and extending normal to said base plate for normally extending vertically therefrom;

a base frame assembly defined by cross frame members on said base plate for securing said tubular housing to said base plate, said base frame assembly comprises a plurality of elongated rectangular plates defining said cross frame members secured to and extending outwardly from said tubular housing and a lateral support leg having a lower end secured to the outer end of each of said plates and an upper end secured to said housing at a position upward from the lower end thereof;

a tubular bearing member having a length greater than said housing telescopically mounted in said housing and having means defining an upper bearing surface;

a mainframe support bracket having an upwardly opening channel configuration for receiving a mainframe member of a building;

a screw and nut assembly secured to said support bracket for adjustably supporting same in said tubular bearing member; and at least one spacer block for supporting said tubular bearing member in said tubular housing member at a selected elevated position relative thereto.

7. An adjustable support device for a building and the like comprising:

a base plate for resting on a generally horizontal support surface;

a tubular housing having an upper end and a lower end secured at said lower end to and extending normal to said base plate for normally extending vertically therefrom;

a base frame assembly defined by cross frame members on said base plate for securing said tubular housing to said base plate, said base frame assembly comprises a plurality of elongated rectangular plates defining said cross frame members secured to and extending outwardly from said tubular housing and a lateral support leg having a lower end secured to the outer end of each of said plates and an upper end secured to said housing at a position upward from the lower end thereof;

a tubular bearing member having a length greater than said housing telescopically mounted in said housing and having means defining an upper bearing surface;

a mainframe support bracket having an upwardly opening channel configuration for receiving a mainframe member of a building;

a screw and nut assembly secured to said support bracket for adjustably supporting same in said tubular bearing member;

said housing is a square tube and said base frame assembly defines a triangular frame secured between each side of said housing and said base;

at least one spacer block for supporting said tubular bearing member in said tubular housing member at a selected elevated position relative thereto; and further comprising clamp means on said support bracket for securing a flanged mainframe member to said support bracket.

8. An adjustable support device for a building and the like comprising:

a water impervious base plate having a generally rectangular configuration with planar top and bottom surfaces for resting on a generally horizontal support surface;

a tubular housing having an upper end and a lower end secured at said lower end to and extending normal to said base plate for normally extending vertically therefrom;

a base frame assembly defined by a plurality of elongated rectangular plates secured to and extending outwardly from said tubular housing and a plurality of lateral support legs, each having a lower end secured to the outer end of one of said plates and an upper end secured to said housing at a position upward from the lower end thereof for securing said tubular housing to said base plate;

a tubular bearing member having a length greater than said housing telescopically mounted in said housing and having means defining an upper bearing surface;

a mainframe support bracket having an upwardly opening channel configuration for receiving a mainframe member of a building;

clamp means on said support bracket for securing a flanged mainframe member to said support bracket; and a screw and nut assembly mounted in said tubular bearing member and secured to said support bracket for adjustably supporting same in said tubular bearing member.

9. An adjustable support device for a building and the like according to claim 8 comprising at least one spacer block for supporting said tubular bearing member in said tubular housing member at a selected elevated position relative thereto.

* * * * *